US008382117B1

(12) United States Patent
Harris

(10) Patent No.: US 8,382,117 B1
(45) Date of Patent: Feb. 26, 2013

(54) MODULAR ARCHERY TARGET

(75) Inventor: Ralph R. Harris, Tell City, IN (US)

(73) Assignee: American Whitetail, Inc., Ferdinand, IN (US)

( * ) Notice: Subject to any disclaimer, the term of this patent is extended or adjusted under 35 U.S.C. 154(b) by 0 days.

(21) Appl. No.: 13/478,111

(22) Filed: May 23, 2012

Related U.S. Application Data

(63) Continuation of application No. 13/114,189, filed on May 24, 2011.

(51) Int. Cl.
*F41J 3/00* (2006.01)

(52) U.S. Cl. ..... 273/403

(58) Field of Classification Search ..... 273/403–410
See application file for complete search history.

(56) References Cited

U.S. PATENT DOCUMENTS 3,048,401 A * 8/1962 Dishon ..... 273/407
4,066,261 A * 1/1978 Stewart ..... 273/403
4,239,236 A * 12/1980 Parham et al. ..... 273/403
4,294,452 A * 10/1981 Schlotter et al. ..... 273/403
5,308,084 A * 5/1994 Morrell ..... 273/403
5,533,430 A * 7/1996 Buch ..... 83/171
6,254,100 B1 * 7/2001 Rinehart ..... 273/403
6,926,281 B1 * 8/2005 Woock ..... 273/403
7,744,090 B1 * 6/2010 Nettle ..... 273/403
2003/0222403 A1 * 12/2003 Ingold ..... 273/408
2004/0140623 A1 * 7/2004 Pulkrabek ..... 273/408
2007/0029733 A1 * 2/2007 Anderson ..... 273/408
2011/0024986 A1 * 2/2011 Walker ..... 273/403
2012/0080848 A1 * 4/2012 McGovern et al. ..... 273/408

* cited by examiner

*Primary Examiner* — Mark Graham
(74) *Attorney, Agent, or Firm* — Paul E. Lewkowicz P.C.

(57) ABSTRACT

Presently disclosed is a modular archery target with specialized components for stopping multiple arrow types. The target may consist of a hollow outer shell, in round or polygon configuration, a plurality of interchangeable cores, and an optional rigid cap. In some embodiments, the interchangeable cores may comprise a compression core and a broadhead core. To maintain inner compression core location, elastic bands may be used to secure the rigid cap to the hollow outer shell. The compression core may be made of various loose materials contained in a bag. The broadhead core may be made of laminated or molded foam material. The outer shell may be comprised of molded of laminated foam.

12 Claims, 6 Drawing Sheets

MODULAR ARCHERY TARGET

CROSS-REFERENCE TO RELATED APPLICATIONS

This application is a CONTINUATION-IN-PART of the commonly-owned, co-pending U.S. patent application Ser. No. 13/114,189 (filed on May 24, 2011), which is incorporated herein by reference in its entirety, and claims priority thereto.

FIELD OF THE INVENTION

This invention relates generally to the field of archery targets and more specifically to a modular archery target with specialized components for stopping multiple arrow types and having self-repairing properties.

BACKGROUND

A typical archery target includes, among other things, a face (such as the well-known colored concentric rings of international competition, made of paper or waterproof film), a backstop for decelerating and holding the shot arrows, and (optionally) a stand for elevating the face and backstop above ground level. Target backstops, referred to generally and throughout this document as "targets," may be made from many kinds of materials. Simple straw, hay, or excelsior bales are long known as sufficient for stopping the slower, heavier wooden arrows of old. Today's aluminum, carbon, and composite arrows, coupled with powerful, high-speed cross- and compound bows result in arrows with sufficient kinetic energy to pass completely through old-fashioned targets.

Various target configurations have been used to stop arrows, using either friction or compression schemes to absorb the energy of the arrow. One type of target is a compressed foam sheet target, such as the Block® Wall System target manufactured by Field Logic Inc. of Superior, Wis. This type of target stops arrows with friction from the compression force on the foam sheets. This target can be used with arrows having either field or target points (referred to herein generally as "target points") or bladed hunting points such as, without limitation, fixed or expandable (mechanical) broadheads (referred to collectively herein as "broadheads"), as those terms are known in the art.

Compressed foam sheets, or open layer targets, stop arrows by friction between the sheets. This causes heat, and with high-speed arrows, the foam (typically polyethylene) will melt to the arrow shaft. This results in difficult arrow removal and damage to the arrows. When shot with broadheads, the target life is greatly reduced, as the individual sheets of foam sliver and fall out of the target. And, regardless of the compression method used, broadheads will soon destroy the main body of the target.

Another type of target is constructed from solid foam, layered either in sections or in a molded shape. One example is The Cube, manufactured by American Whitetail, Inc. of Ferdinand, Ind. This target can be made of various polymeric foams, such as (without limitation) polyurethane and polyethylene, and is suitable for either broadheads or target points.

Solid foam targets, whether molded or layered in sections, stop arrows by friction. This foam will also melt to the arrow shaft, making arrow removal difficult. Broadheads work better with solid targets, however the main body will still be destroyed with repeated shots.

Another type of target is a compression bag target designed for target points, with packed material in a bag, either woven or non-woven. One typical example is the Morrell Bone Collector Outdoor Range manufactured by Morrell Manufacturing, Inc. of Alma, Ark. This type of target is suitable for target points only, as broadheads cannot easily be removed and tend to shred the target.

Compression bag targets feature a packed material in a bag, usually a woven polypropylene. These targets develop voids over time when shot repeatedly in the same area with target points, which may result in a shorter target life. Being a bag, the target usually needs a stand to support it. Arrows shot into a bag target usually cannot be scored accurately because the compression method of the target does not allow the arrow shaft to be held where it impacted, and it will sag or shift, resulting in difficulty scoring the hit location. The energy of fast arrows also requires extremely heavy and bulky bag targets to stop them.

Other targets made of solid, layered, or laminated man-made materials are also well known. Carpet strips, plastic sheet material, DuPont Tyvek®, and rag bundles are some of the other materials used.

One well-known disadvantage of current targets is commonly seen in youth shooting instruction and competition, where young archers and low draw weight bows result in arrows that have insufficient kinetic energy to penetrate and/or stay embedded in the target. This is often the result of youths using targets that are designed for much stronger and faster bows. Such targets are typically too dense to allow a slow, youth arrow to penetrate and may even cause the arrow to bounce off (called a "bounce out" in competition).

Because of advancement in archery equipment, and the change to composite materials for arrow construction, there is an interest in a archery target that has a long service life, that has easy arrow removal, has a repairable core and can be used for both target points and broadheads.

SUMMARY

In contrast to the above-described conventional approaches, embodiments of the invention are directed to a modular target system that is capable of stopping fast arrows, long-lived, adaptable to stopping arrows tipped with either target points or broadheads without damaging the arrows, allows easy arrow removal, and does not suffer rapid degradation.

One embodiment of the invention is directed to a modular archery target with specialized components for stopping multiple arrow types comprising a hollow outer shell, which may be in an approximately cubic or generally polygonal configuration and able to stop arrows shot into all flat, vertical sides on all flat sides; an inner compression core; a removable rigid cap positioned over an open end of the hollow outer shell to maintain inner compression core location; and a [solid and/or laminated] separate broadhead core that is interchangeable with the inner compression core for use with broadheads.

The modular archery target is configured to stop arrows with target points shot into its vertical sides using the inner compression core and making full use of the target side area. The removable rigid cap, which is (in some embodiments) attached by elastic cords, keeps an essentially constant downward compression on the inner compression core, thus maintaining the inner core's position within the hollow outer shell. The rigid cap, when removed, allows the inner core to be accessed resulting in three advantageous features. First, the inner core can be rotated or re-positioned, thereby bringing new material to the shooting area. Second, the rigid cap assists the core in self-healing. Third, removability allows mass to be added to the inner core if needed.

When the archer desires to practice with broadheads, a separate broadhead core replaces the rigid cap and the inner compression core. Broadheads are then shot directly into the broadhead core from the open end of the hollow outer shell, instead of through the sides of the outer shell, i.e., the target is tipped onto its side for shooting broadheads into the top. By shooting directly into the broadhead core, the main body of the target's hollow outer shell is spared the cutting action of the broadheads, thus preserving the main body of the target and adding significant target life.

An alternate embodiment of the invention is directed to a modular archery target with specialized components for stopping multiple arrow types comprising a hollow outer shell, which may be in an approximately cubic or generally polygonal configuration and able to stop arrows shot into one flat, vertical face (i.e., the shooting face); an plurality of removable and interchangeable concentric center cores into the shooting face; and a removable compression bag positioned through and inside the open end of the hollow outer shell opposite the target face.

It is therefore a primary object of the invention to provide an improved archery target that addresses the limitations and disadvantages of prior archery targets. A further object of the invention is to provide an archery target that is self-repairing. Yet another object of the invention is to provide an improved archery target that maintains compression on its internal core to prevent voids from forming when shooting. Another object of the invention is to provide an improved archery target that allows broadhead shooting into a removable and replaceable broadhead core to preserve the outer shell. Another object of the invention is to provide an improved archery target that is compatible with all crossbows and compound bows, as well as more traditional types of longbows and recurve bows.

Other objects and advantages of the present invention will become apparent from the following descriptions, taken in connection with the accompanying drawings, wherein, by way of illustration and example, embodiments of the present invention is disclosed.

BRIEF DESCRIPTION OF THE DRAWINGS

The foregoing and other objects, features and advantages of the invention will be apparent from the following description of particular embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION

Embodiments of the present apparatus are directed to an improved archery target with modular elements. The improved archery target has an essentially rigid and hollow outer shell with two, interchangeable cores adapted to support different arrowheads. One core comprises an inner compression core that stops arrows with target points by compression. In some embodiments, the compression core can be rotated within the outer shell to both extend target life and self-repair the compression core. The second core may comprise a broadhead core for use with arrows tipped with broadheads. The archer can easily change cores to accommodate the type of practice—target (using target points) or hunting (using broadheads)—the archer wishes to accomplish.

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

In its target point embodiment, the present target comprises an inner compression core encased and compressed inside of a hollow shell. When impacted an arrow, the foam shell maintains the relative position of the arrow strike while the inner compression core absorbs the arrow's energy, allowing easy arrow removal. The inner core is self-repairing in that the shell can be opened to allow the inner core to be rotated or repositioned ("fluffed") inside the shell, thus bringing new material into the area being shot. This also assists in the self-healing properties of the inner core. Additionally, the core may be repaired by adding more compression material.

Figure 1:
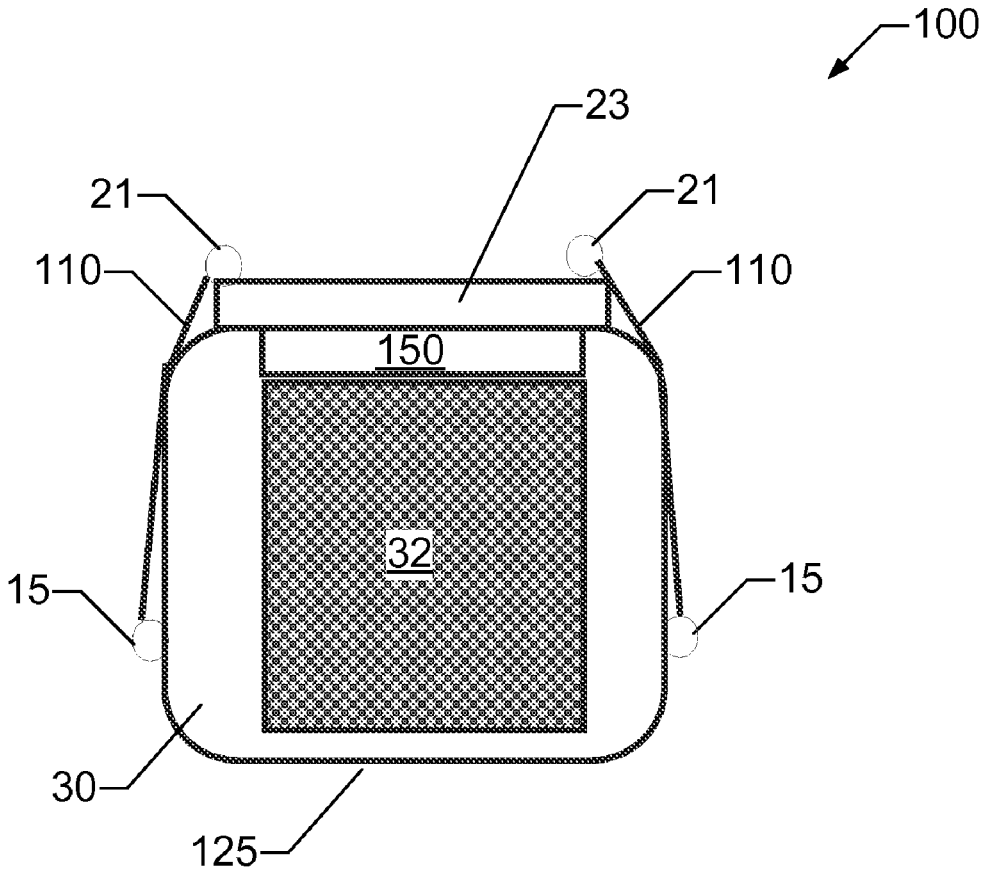
FIG. 1 is a cross-sectional view of a target with a rigid cap and inner compression core installed, according to one embodiment of the present invention.
Figure 4:
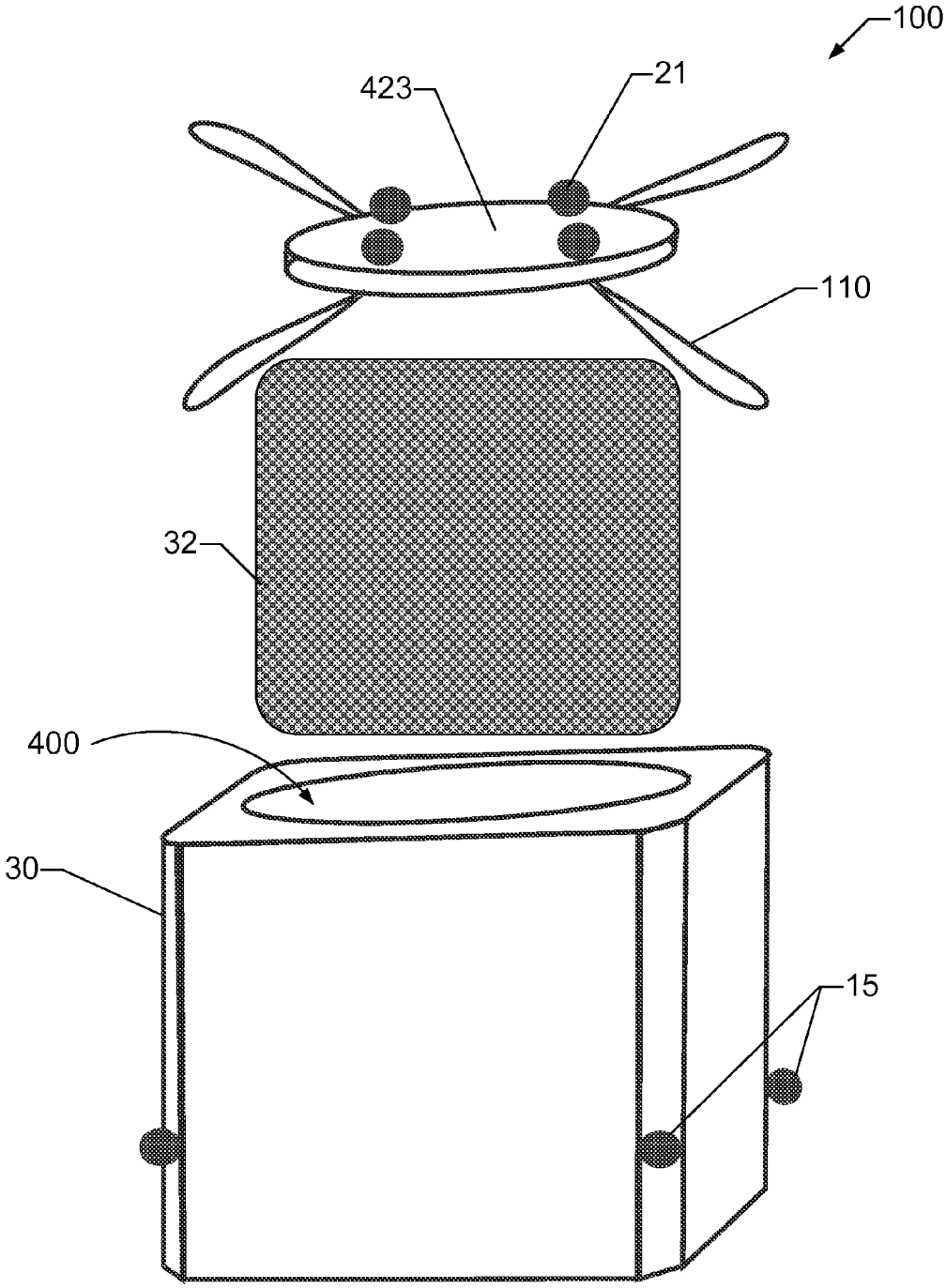
FIG. 4 is an exploded view of the target of FIG. 1, according to one embodiment of the present invention.
Figure 5:
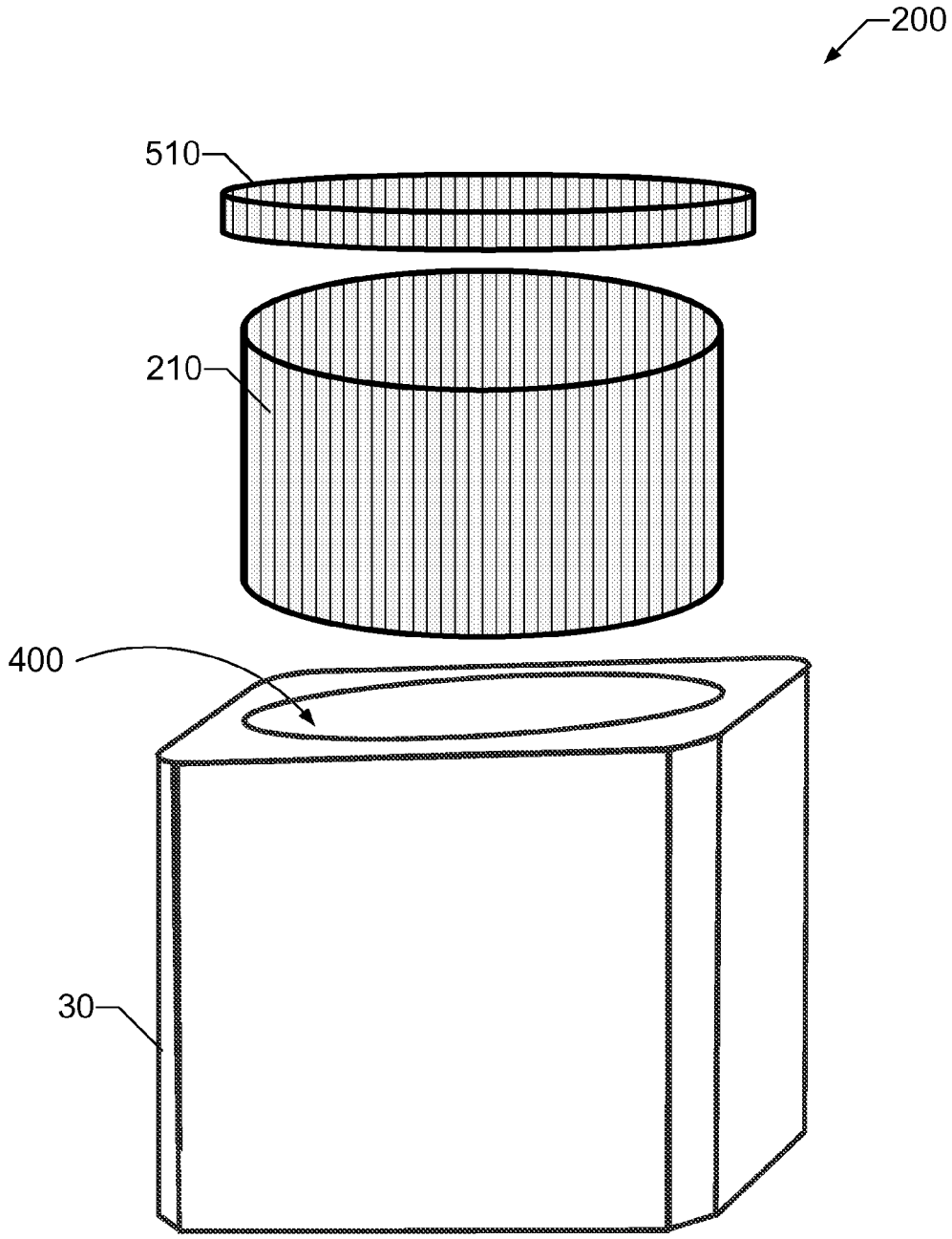
FIG. 5 is an exploded view of the target of FIG. 2, according to one embodiment of the present invention.

Referring to FIG. 1, an assembled modular target 100, constructed according to one target point embodiment of the present invention, is shown in a cut-away side view. Target 100 comprises, in this exemplary embodiment, a hollow outer shell 30. Outer shell 30 may be roughly cubical as illustrated, but may generally be described as polyhedral with at least six shooting surfaces. Although a cubic target is illustrated, those skilled in the art will realize that target shapes other than a cube, such as and without limitation, an elongated rectangle (rhomboid or parallelepiped), an octahedron, or a cylinder, can be used. Accordingly, the concepts, systems, and techniques described herein are not limited to any particular target shape. In a preferred embodiment, outer shell is in the form of a cube with beveled edges, as illustrated in FIGS. 3-5.

Figure 3:
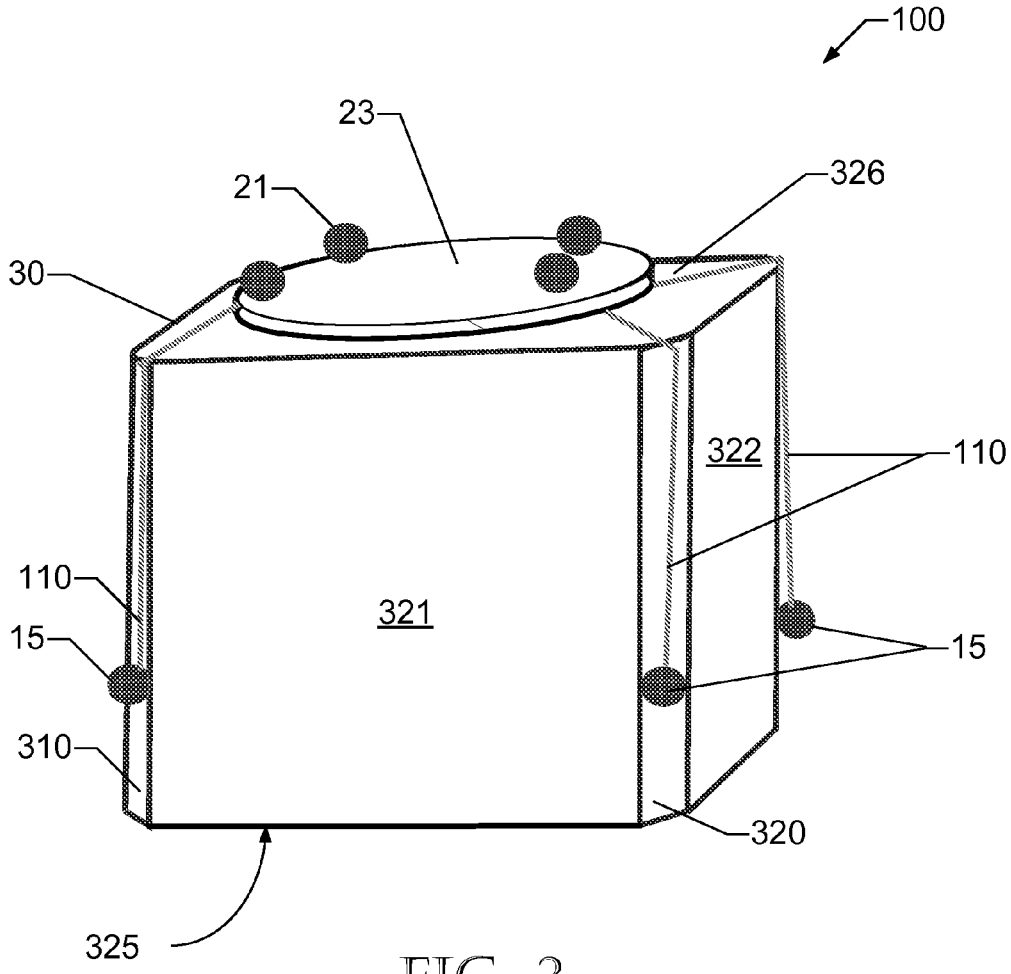
FIG. 3 is an isometric view of a target according to one embodiment of the present invention.

In one exemplary embodiment, illustrated in the isometric view of FIG. 3, outer shell 30 is open on the top end 326 and substantially hollow, having four sides and a bottom 325. Sides 321 and 322, upon which the target faces are typically attached are shown; sides 323 and 324 are hidden. Bottom 325 is likewise out of view. In this view, a cap 23 is attached to top 326 with four fasteners 110 (three shown) threaded through holes in cap 23 and anchors 15. Balls 21, as described further below, may be used as stoppers to prevent the fasteners 110 from pulling out of their respective holes in cap 23. Anchors 15 may also be comprised of balls fixedly attached to outer shell 30, although many other anchors are equally useable.

Although a cord-and-ball fastening scheme is described, those skilled in the art will realize that many other methods of attaching cap 23 to outer shell 30 can be used. For example, and not by way of limitation, cap 23 may have a stepped profile (as illustrated in FIG. 1) wherein the smaller portion 150 is held in place by a friction fit to the interior cavity of outer shell 30. Alternatively, cap 23 may be substantially cylindrical with threading or locking cams on its other periphery so adapted as to engage matching threads or lugs in outer shell 30, thereby obviating the need for fasteners. It should be apparent to one of ordinary skill in the art that other fastening means may be employed without limitation. Accordingly, the concepts, systems, and techniques described herein are not limited to any particular type of cap attachment scheme.

Outer shell 30 may be made from any pierceable, rigid, and waterproof material, such as (but not limited to) a polymeric foam such as polyolefin foam or polyethylene foam, such as OLETEX®, VOLARA®, ETHAFOAM™, and the like. Outer shell 30 is preferably constructed from polyurethane, which allows one handed arrow removal without the arrow bonding to (melting) the outer shell material.

OLETEX is a registered trademark of Armacell, LLC of South Holland, Ill. VOLARA is a registered trademark of Sekisui Voltek, LLC of Massachusetts. ETHAFOAM is a trademark of Dow Chemical Corp. of Wilmington, Del.

Target 100 may further comprise an inner compression core 32 and a rigid cap 23. Rigid cap 23 may, in some embodiments, comprise a stepped, substantially cylindrical polyurethane foam disc friction-fit into an appropriately sized cavity in the top of outer shell 30, as discussed above. Alternately, rigid cap 23 may be held in place with one or more cap attaching fasteners such as (but not limited to) cords 110 secured to anchors 15. In one exemplary embodiment, four cords 110 are used, spaced equidistant around the perimeter of rigid cap 23 and anchored to the vertical edges of outer shell 30. The actual location of the anchors need not be as shown. Any convenient location, out of the way of the side that the archer intends to shoot, may be used without limitation. In an alternate embodiment (not shown), cap 23 may be a single cylindrical plate, as (for example) that depicted as cap 423 in FIG. 4. In general, cap 23 may be any polyhedral shape having a thickness of about 2 inches and sized to completely cover the cavity opening in outer shell 30.

Cap attaching fasteners (in one exemplary embodiment, cords 110) may be comprised of any flexible binding material, such as rope, elastic ("bungee" or shock) cords, springs, metal bands, fabric strips, webbing, strapping, or the like without limitation. In one exemplary embodiment, cords 110 comprise elastic bungee cords formed into a loop with a ball fastened to one end. Cords 110 are secured to outer shell 30 by, in some embodiments, hooking the loop over anchor 15, as illustrated in FIG. 3. Anchor 15, in turn may comprise an essentially round ball attached to outer shell 30 by any attachment means known in the art, preferably in permanent matter resistant to loosening or breaking away from outer shell 30. In one exemplary embodiment, anchor 15 comprises a ball on a loop of bungee cord attached to outer shell 30 by passing the loop through the shell. A second ball (not shown) prevents the loop from pulling through.

In a preferred embodiment, the anchor may be attached to the cap and the fastener may be attached to the outer shell. The fastener may be a ball-ended bungee cord loop that is threaded through the outer shell so that the ball prevents the bungee from pulling out. To fasten the cap, the loop is stretched to hook over the anchor on the cap.

In another embodiment, loops of webbing material may be fixedly attached to the cap. As above, a ball-ended bungee cord loop (or other fastener) may be threaded through the outer shell so that the ball prevents the bungee from pulling out. To fasten the cap, the bungee cord loop is passed through the webbing loop on the cap and stretched back down to hook over the ball.

In general, the fixed end of a bungee fastener may be may be attached to rigid cap 23 or outer shell 30 by any attachment means known in the art, preferably in a permanent matter resistant to loosening or breaking away from rigid cap 23 or outer shell 30. One of ordinary skill in the art will readily appreciate that the present means of attachment may be used to fix anchor 15 and/or fasteners 110 without limitation.

Inner compression core 32 comprises an outer bag or envelop made from a flexible woven or non-woven fabric (such as, without limitation, polypropylene or burlap) and a compression material composed of a mixture of strips or pieces of polyethylene, polyester, and thermally bonded polyester batting. In a preferred embodiment, the outer bag may be polypropylene. The inner compression core stops the arrow before heat can develop so there is no bonding to outer shell 30.

Rigid cap 23 maintains a downward pressure on inner compression core 32 while outer shell 30 keeps compression core 32 contained and tightly packed. This maintains the integrity of compression core 32 while it is being shot, so that no voids develop in the core compression material.

FIG. 4 is an exploded view of one embodiment of target 100, illustrating compression core 32 removed from cavity 400 of outer core 30. Fastener 110 is here illustrated as a cord loop attached to cap 23 by ball stopper 21, although, as noted above, those skilled in the art will realize that cap-attaching fasteners other than the cord-and-ball arrangement described herein can be used.

Target 100 can be used either indoors or outdoors and can be shot with field points in the configuration shown in FIGS. 1, 3, and 4, i.e., with inner compression core 32 and rigid cap 23 held in place with cords 110 secured to anchors 15.

Figure 2:
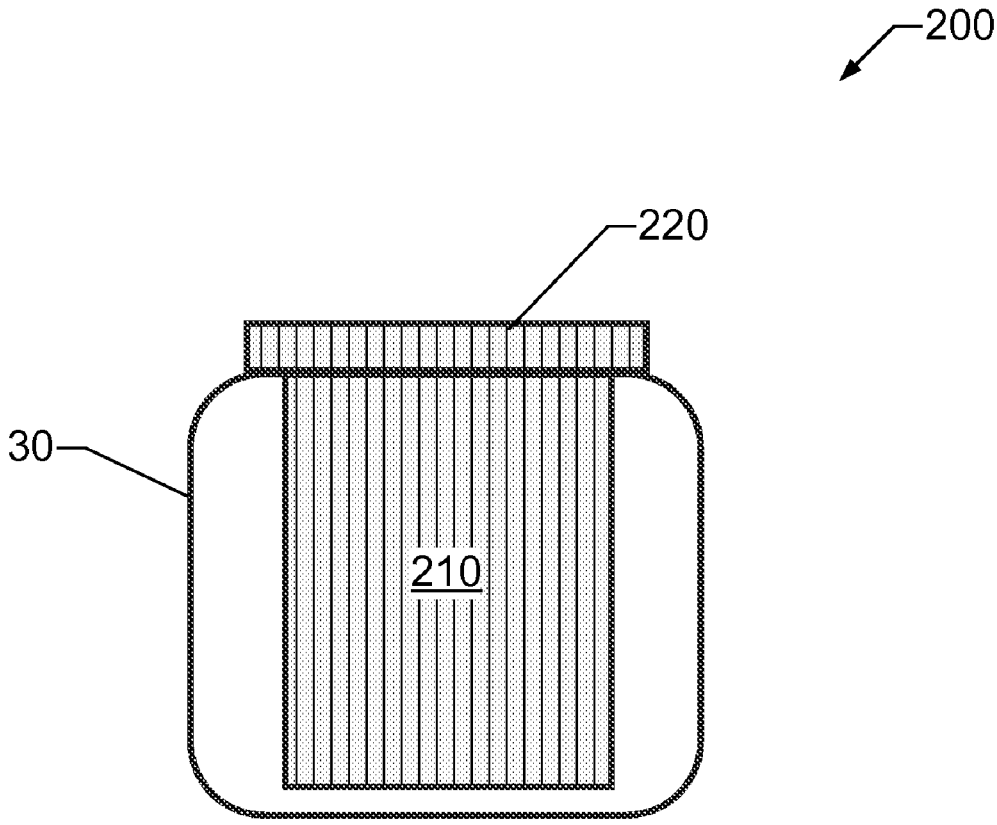
FIG. 2 is a cross-sectional view of a target with a rigid cap and broadhead core installed, according to one embodiment of the present invention.

For shooting broadheads, rigid cap 23 (or 423) and compression core 32 are removed. Inner compression core 32 is replaced with a solid or laminated foam broadhead core 210, as shown in the cut away side view of FIG. 2. Broadhead core 210 may comprise an integral cap flange 220, formed as part of core 210. Such a cap flange covers the space between core 210 and the perimeter of cavity 400 (referring to FIG. 5) in order to stop wayward arrows. Alternately, cap flange 220 may be laminated, or other otherwise permanently attached, to broadhead core 210. In yet another embodiment, cap flange 220 may be entirely replaced by rigid cap 510 (referring to FIG. 5) and attached to outer shell 30 by any of the fastener methods described above (not shown).

To use the broadhead core, outer shell 30 must be placed on a side 321-324 (referring to FIG. 4) so that the archer shoots at the top end, orthogonal to the sides 321-324 shot with target points (i.e., into the hollow cavity formed by outer shell 30 and now filled with broadhead core 210). The broadheads thus enter the broadhead core 210 from the open, top end of outer shell 30, keeping the broadhead's razor sharp blades from destroying outer shell 30. Broadhead core 210 takes all of the damage from the broadheads so that the main target body (outer shell 30) is not damaged.

Broadhead core 210 may comprise any solid or laminated foam material suitable for stopping arrows known in the art. In a preferred embodiment, broadhead core comprises a polyethylene foam in a two to six pound density. Alternatively, broadhead core made be laminated from pieces of polyethylene or polyurethane FIG. 5 is an exploded view of one embodiment of target 200, illustrating broadhead core 210 removed from cavity 400 of outer core 30. In this exemplary embodiment, a separate, substantially rigid cap 510 is shown. As noted above, various means for attaching cap 510 may be employed.

Figure 6:
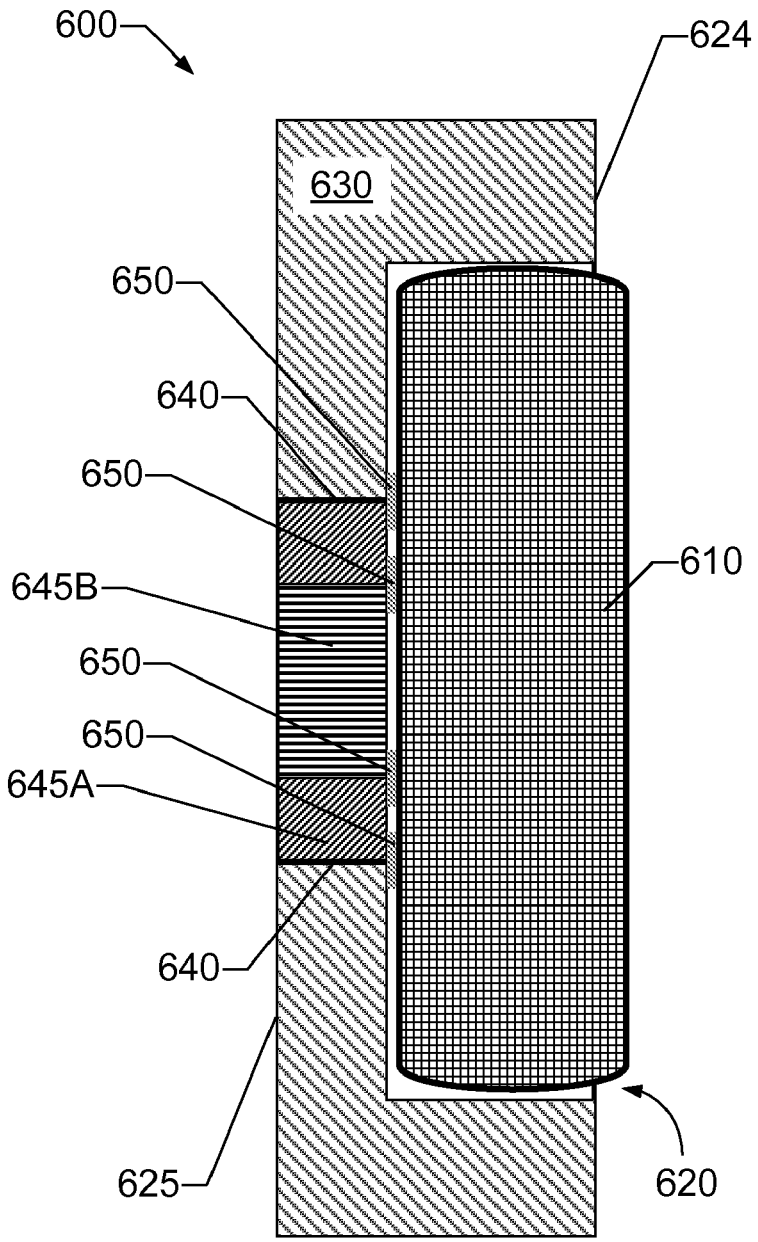
FIG. 6 is a cross-sectional view of a target with a removable center core and inner core installed, according to one embodiment of the present invention.

In another exemplary embodiment, described with reference to the cross-section view of FIG. 6, a target 600 may comprise an inner core 610 surrounded by and compressed in a cavity 620 formed by hollow outer shell 630. Shell 630 has a substantially flat or planar front face 625 on which a paper target (omitted for clarity) is typically fastened. When impacted by an arrow, the shell maintains the relative position of the arrow strike in the paper target while the inner core 610 absorbs the arrow's energy, allowing easier arrow removal as discussed above. The inner core 610, which may be a compression bag, solid or laminated foam element (without limitation), may be self-repairing in that it is accessible from the back side 624, i.e., the side of the target opposite the target face, containing and defining the cavity 620 in which the bag is located. The inner core can also be rotated, or, when supplied in bag form, repositioned ("fluffed") inside the shell, thus bringing new material into the area being shot. Additionally, a bag-type inner core may be repaired by inserting more compression material.

Outer shell 630 is open on the back side 624 and substantially hollow, having four sides and a front face 625 upon which the target faces are typically attached. Inner core 610 may be attached to outer shell 630 by any of the fastening means discussed above, without limitation. The fastening means are omitted from this Figure for clarity of illustration.

Hollow outer shell 630 may have an aperture 640 formed in and through front face 625 in the centermost region of target 600. The aperture may have one or more substantially rigid, yet removable, center core elements 645 disposed therein. Such a center core element may provide two benefits: it may be constructed of a firmer, more damage-resistant type of foam so as to be able to withstand more arrow hits, and it is more easily replaceable when it become shot out. In FIG. 6, two concentric center core elements 645A and 645B are shown, although more or fewer cores could be used, without limitation.

In one exemplary embodiment, hollow outer shell 630 and/or center core elements 645 may be formed from sheet foam that is rolled up (or laminated) and cut out to form the desired shapes. In an alternate embodiment, outer shell 630/ or center core elements 645 may be molded from polyurethane by conventional means.

Center core elements 645 may, in one exemplary embodiment, be held in place by a friction fit. In an alternate embodiment, bridge pieces 650 formed of foam block or sheet material may be glued or otherwise fastened to center core 645 to prevent it from being pulled out of the face 625 of the target when a high-scoring arrow is removed. Four representative bridge pieces 650 are shown in the section view of FIG. 6. Bridge pieces 650 are attached to only one side of the interface (typically, although without limitation, to the inner most of the concentric pieces) so that any of the center core elements may be removed (from the cavity side) separately from the others and replaced as needed.

Center core 645 may, in some embodiments, be formed of two or more approximately concentric elements, each separately removable and replaceable. Core elements 645 need not be round, although (given the typical distribution of arrow hits around the center of a target), round elements are preferred. Regardless of the size, shape, or number of core elements 645, bridge pieces 650 may be secured to each of these elements, in one embodiment, so that none of them will be pulled out the front of the target.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

While particular embodiments of the present invention have been shown and described, it will be apparent to those skilled in the art that various changes and modifications in form and details may be made therein without departing from the spirit and scope of the invention as defined by the following claims. Accordingly, the appended claims encompass within their scope all such changes and modifications.

I claim:

1. A modular archery target, comprising:

a hollow outer shell, having a cavity formed in a side thereof and an aperture formed in a side opposite said cavity;

a removable inner core sized to fit snugly within said cavity, said inner core removeably fastened to said outer shell and substantially filling said cavity when said inner core is fitted therein; and a substantially rigid center core removeably disposed in said aperture, wherein said inner core is fastened to said outer shell with a plurality of fasteners disposed around the perimeter of said cavity and wherein said fasteners comprise bungee cords.

2. The modular archery target of claim 1, wherein said outer shell is comprised of molded polymeric foam.

3. The modular archery target of claim 1, wherein said outer shell is comprised of laminated polymeric foam elements.

4. The modular archery target of claim 1, wherein said inner core comprises a compression core.

5. The modular archery target of claim 1, wherein said inner core is comprised of a plurality of loose materials encased in a bag.

6. The modular archery target of claim 1, wherein said center core is held within said aperture by friction.

7. The modular archery target of claim 1, wherein said center core is comprised of two or more substantially rigid, concentric elements.

8. The modular archery target of claim 1, wherein said center core comprises at least one laminated foam element.

9. The modular archery target of claim 1, wherein said center core comprises at least one solid foam element.

10. The modular archery target of claim 1, wherein said center core is prevented from being removed from said outer shell by bridge pieces attached to said center core on the cavity side thereof.

11. The modular archery target of claim 10, wherein said bridge pieces comprise foam sheets.

12. The modular archery target of claim 10, wherein said bridge pieces comprise foam blocks.

* * * * *